United States Patent [19]

Anderson et al.

[11] Patent Number: 4,861,043

[45] Date of Patent: Aug. 29, 1989

[54] PRESSURE/COMPRESSION CONCRETE JOINT SEAL

[75] Inventors: Joseph Anderson, Atherton; Barney T. Baldi, Eldorado Hills; John M. Engstrom, Walnut Creek, all of Calif.

[73] Assignee: Bechtel International Corporation, San Francisco, Calif.

[21] Appl. No.: 144,599

[22] Filed: Jan. 11, 1988

Related U.S. Application Data

[63] Continuation of Ser. No. 846,371, Mar. 31, 1986, abandoned.

[51] Int. Cl.[4] ..... E01C 11/02; E01C 11/10; F16J 15/10

[52] U.S. Cl. ..... 277/1; 52/396; 52/403; 277/205; 277/207 R; 404/65; 404/66; 404/74

[58] Field of Search ..... 277/1, 205, 207 R, 208–210, 277/228, 229, 181, 184, 186; 404/64–69, 74; 52/396, 403; 49/493, 482

[56] References Cited

U.S. PATENT DOCUMENTS

| | | | |
|---|---|---|---|
| Re. 31,283 | 6/1983 | Puccio . | |
| 2,156,681 | 5/1939 | Dewhirst et al. | 404/65 |
| 3,119,204 | 1/1964 | Williams | 404/64 X |
| 3,136,022 | 6/1964 | Dohren | 404/64 |
| 3,179,026 | 4/1965 | Crone | 52/396 X |
| 3,387,544 | 6/1968 | MacLellan et al. | 404/65 |
| 3,388,643 | 6/1968 | Webb | 404/65 |
| 3,645,176 | 2/1972 | Berchou | 404/64 |
| 3,709,115 | 1/1973 | Brown . | |
| 3,732,788 | 5/1973 | Brown . | |
| 3,896,597 | 7/1975 | Deason | 404/64 X |
| 4,067,660 | 1/1978 | Puccio . | |
| 4,111,584 | 9/1978 | Fyfe | 52/396 X |
| 4,119,387 | 10/1978 | Brown | 52/396 X |
| 4,127,350 | 11/1978 | Weber . | |
| 4,140,419 | 2/1979 | Puccio . | |
| 4,148,167 | 4/1979 | Puccio | 52/396 |
| 4,279,533 | 7/1981 | Peterson et al. | 404/74 X |
| 4,388,016 | 6/1983 | Levey . | |
| 4,437,785 | 3/1984 | Puccio . | |
| 4,457,522 | 7/1984 | Trieste et al. | 404/64 X |

FOREIGN PATENT DOCUMENTS

| | | | |
|---|---|---|---|
| 318387 | 12/1969 | Sweden | 404/64 |
| 17164 | of 1914 | United Kingdom | 404/64 |
| 1422871 | 1/1976 | United Kingdom | 277/207 R |

*Primary Examiner*—Allan N. Shoap
*Attorney, Agent, or Firm*—Townsend and Townsend

[57] ABSTRACT

A joint seal comprises two elastomeric elements, configured to fit as a nested assembly within the gap between adjacent slabs. The outer element (the "outer seal") is a generally U-shaped channel (with sides and a bottom), and performs the actual sealing function. The outer surfaces of the channel sides are formed with a series of longitudinally-extending fins, which frictionally engage the slab edges. The inner element ("the core") is formed as a generally rectangular tube that provides a structural strength for the seal assembly. It includes a tubular outer wall and an internal truss-type framework consisting of a number of interconnected webs. The seal assembly is installed under compression.

13 Claims, 4 Drawing Sheets

----- ORIGINAL

——— DEFORMED

PRESSURE/COMPRESSION CONCRETE JOINT SEAL

This is a Continuation of application Ser. No. 846,371, filed Mar. 31, 1986, now abandoned.

FIELD OF THE INVENTION

The present invention relates generally to the sealing of joints, and more particularly to a seal for preventing leakage between adjacent concrete slabs in the bottom of a liquid-retaining structure.

BACKGROUND OF THE INVENTION

It is well known to form a large expanse of concrete as a series of discrete slabs separated by appropriate expansion joints. When such a structure forms the lining of a canal, reservoir, or the like, the ability of such expansion joints to remain water-tight becomes a significant issue, and provision must be made to provide some sort of joint seal.

By way of example, consider a seawater canal, perhaps on the order of 10 km long with three channels, each 30 m wide and 6 m deep. Naturally, the seal must prevent water leakage under the normal hydrostatic pressure of approximately 10 psi. Furthermore, if the channel is drained of water, the seal must remain in place despite upwardly directed ground water forces. Additionally, since the need for a resilient seal arises from the possibility of relative movement between adjacent slabs due to settlement and the like, the seal must accommodate such movement. For example, the seal may be required to accommodate horizontal displacements (expansion and contraction) of approximately 6 mm and vertical differential displacements on the order of 10–20 mm. Moreover, for longevity, the seal should be able to withstand bacterial and chemical action, ultraviolet irradiation, and extremes of temperature.

One type of prior art joint seal utilizes a resilient sealant such as a polysulfide resin to fill the gaps between slabs. The sealant adheres to the concrete slab edges to provide a water-tight joint. Unfortunately, while such seals are typically effective when initially installed, differential vertical and horizontal movement and environmental effects can cause the adhesion to break down to the point where significant leakage occurs.

The problem of retrofitting the seals on a canal or similar structure is rather different from, and typically more difficult than, the problem of designing and installing the original seals. While there are other types of seal that might be more suitable than those discussed above, they can only be installed as part of the original construction, not as a retrofit.

Thus there is presented the problem of providing a retrofit seal capable of maintaining water-tight joints over a significant range of slab movement and hydrostatic forces.

SUMMARY OF THE INVENTION

The present invention provides a joint seal, suitable for initial or retrofit installation, that meets the performance criteria outlined above. Additionally, the seal is relatively simple to install and inspect and fits flush with the top surface of the slabs so as to be immune to damage during cleaning or maintenance of the canal.

A joint seal according to the present invention comprises two elastomeric elements, configured to fit as a nested assembly within the gap between adjacent slabs. It is generally contemplated that the gap has a stepped configuration, wider at the exposed slab surface so as to define a seal-receiving recess, rectangular in cross-section.

The outer element (referred to as "the outer seal") is a generally U-shaped channel (with sides and a bottom), and performs the actual sealing function. The outer surfaces of the channel sides are formed with a series of longitudinally-extending fins, which frictionally engage the slab edges. The inner element (referred to as "the core") is formed as a generally rectangular tube that provides structural strength for the seal assembly. It includes a tubular outer wall and an internal truss-type framework consisting of a number of interconnected webs.

The sides of the outer seal are formed with inwardly extending flanges at their upper ends to retain the core when it is installed inside the outer seal prior to installation. While the outer seal is installed as a continuous strip, the core is installed as separate sections, each a few meters long, with longitudinal gaps of a few millimeters. This allows the water to fill the inside of the outer seal as well as the core interior, thereby maintaining even pressure at all times.

The seal assembly is installed under compression (approximately 15%) whereupon the fins frictionally engage the concrete and restrict movement of the seal. The internal structure of the core controls the deformation transverse to the length of the seal assembly in a manner that maintains a positive sealing under various conditions. Given that the seal is installed under compression, it automatically provides a certain reserve compression in the event of joint expansion (slab separation). In the event of joint contraction, the core undergoes controlled compression to maintain the outer seal sidewalls in proper alignment and contact with the slab edges. When installed under compression, the core deforms relatively easily in response to shear motion caused by differential vertical movement of the two slabs and maintains the sides of the outer seal vertical and in contact with the slab edges.

Prior to installing the seal assembly, one may coat the facing vertical concrete surfaces (or alternatively the vertical outer surfaces of the seal) with a liquid such as polyurethane resin, which acts as a lubricant and ultimately sets up as an adhesive. In such a case, the fins on the outer surface act as reservoirs for this material so that it can remain in position to increase the sealing action. It is noted, however, that the adhesive is not an essential part of the invention; the geometry and material of the seal itself provide a positive water-tight joint under the various loading conditions.

The present invention is versatile in that the core may be configured in a wide variety of ways so as to accommodate considerations such as manufacturability and cost of materials. A preferred embodiment of the invention contemplates a core configuration including four major internal webs, each joined to the tubular outer wall near a respective corner, and converging to a central region. In some embodiments, additional minor webs extend between the major webs and the outer wall. In other embodiments, the major webs are curved in cross-section.

A further understanding of the nature and advantages of the present invention may be realized by reference to the remaining portions of the specification and the attached drawings.

BRIEF DESCRIPTION OF THE DRAWINGS

.

DETAILED DESCRIPTION OF THE INVENTION

Structure and Installation of Preferred Embodiment

Figure 1:
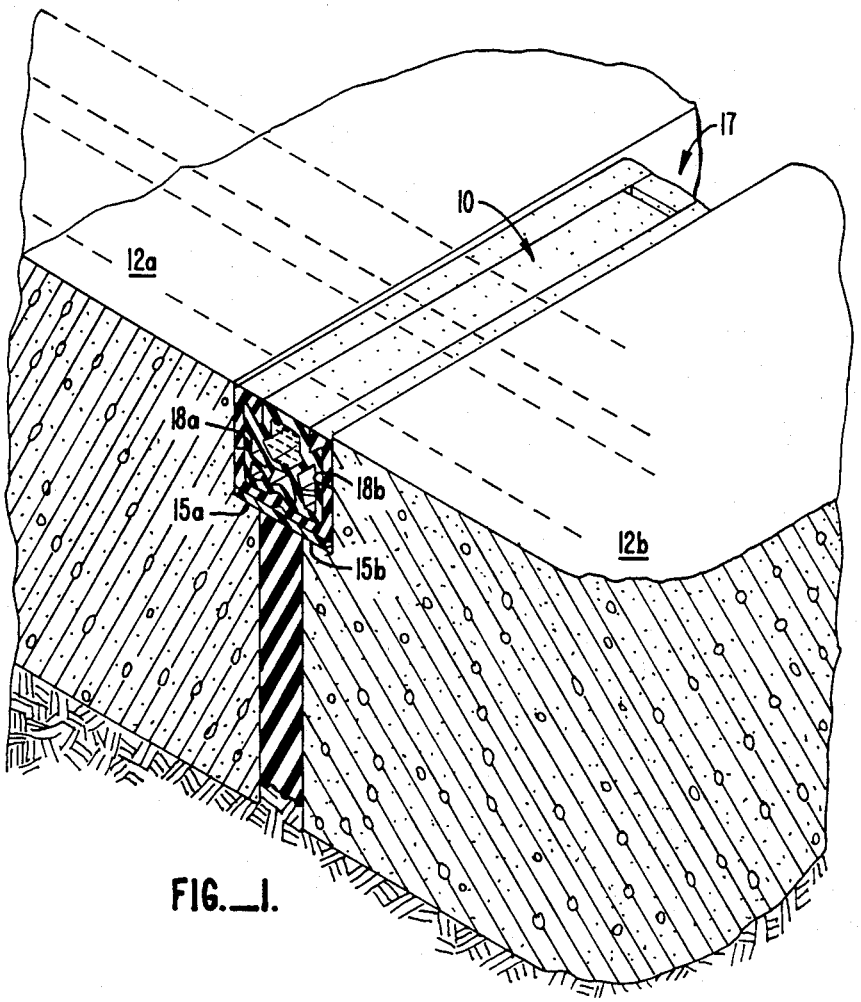
FIG. 1 is a cross-sectional isometric view of an installed joint seal according to the present invention.

FIG. 1 is a cross-sectioned isometric view of a joint seal assembly 10 (sometimes referred to simply as "seal 10") installed between adjacent concrete slabs 12*a* and 12*b*. Although seal 10 is effective regardless of orientation, it will be assumed that the exposed surfaces of slabs 12*a–b* are horizontal, and references to orientation and relative height will reflect that assumption. In actual fact, the seal of the present invention was developed in connection with retrofitting the concrete lining on the bottom and sloping sides of a seawater canal.

The gap has a stepped configuration, widened at the top so as to define a pair of seal-engaging shoulders 15*a* and 15*b* and a seal-receiving recess 17. The latter has facing edges 18*a* and 18*b*. Although specific dimensions are not a part of the present invention, it will be noted that slabs 12*a–b* are generally on the order of 20–30 cm thick. Seal-receiving recess 17 is approximately 4.5 cm wide and 6 cm deep; the lower portion of the gap is on he order of 1–2 cm. In the case where the seal is used to retrofit a previously sealed joint, the lower portion of the gap may contain resilient material from the previous installation.

Seal 10 is basically a two-part elastomeric structure, comprising an outer seal 20 and a nesting core 22. These elements are preferably extruded from neoprene rubber. A typical installation also utilizes a backing strip 25 spanning the gap and supported on shoulders 15*a–b*. The backing strip may be made of a hard plastic. In broad functional terms, seal 10 is a resilient structure, installed under compression, to maintain water-tight contact between the outer surfaces of the seal and facing edges 18*a–b* of the concrete slabs. The water-tight contact is maintained over a range of differential horizontal and vertical movement of slabs 12*a–b*.

Figure 2A:
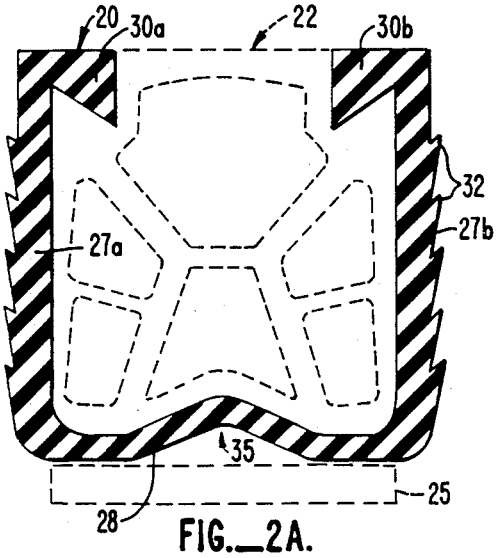
FIGS. 2A–B are cross-sectional views of the components of a preferred embodiment of the joint seal.

FIG. 2A is a cross-sectional view of outer seal 20, with core 22 and backing strip 25 shown in phantom. Outer seal 20 is generally in the form of a U-shaped channel defined by a pair of channel sides 27*a* and 27*b*, and a channel bottom 28. Channel sides 27*a* and 27*b* carry respective core-retaining flanges 30*a* and 30*b* at their upper edges. Each of the channel sides is formed with a plurality of longitudinally-extending, upwardly-angled fins 32 that impart a serrated form to the cross-section. Channel bottom 28 is formed with longitudinally-extending, upwardly-thrust (or downwardly-opening) medial fold 35. In the particular embodiment, the outer dimensions of outer seal 20, exclusive of fins 32, are 2 inches wide and 2 inches high (about 5.1 cm by 5.1 cm) The channel sides are about 4 mm thick; the channel bottom about 3 mm.

Figure 2B:
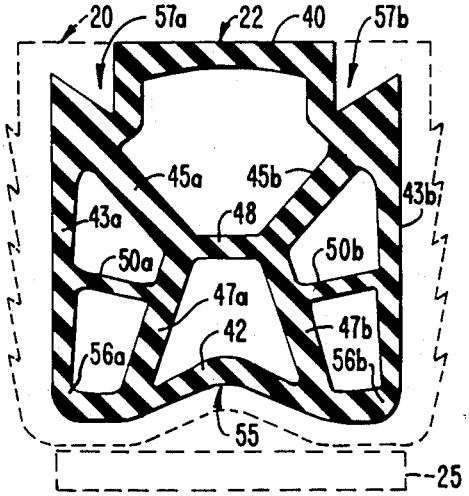

FIG. 2B is a cross-sectional view of core 22 with outer seal 20 and backing strip 25 shown in phantom. Core 22 is generally in the form of a rectangular tube (square in the preferred embodiment) comprising a tubular outer wall and a plurality of internal webs that divide the core interior into a number of longitudinally-extending passageways. More particularly, the tubular outer wall includes a top 40, a bottom 42, and opposed sides 43*a* and 43*b*. The internal webs include four generally diagonally extending major webs, each joining the outer wall near a respective corner, and converging toward a central region. The major webs include a pair of upper webs 45*a–b* and a pair of lower webs 47*a –b*. In the preferred embodiment, each upper web meets a corresponding lower web, and the two convergence points are spanned by a central horizontal web 48. A pair of minor webs 50*a–b* extend between lower webs 47*a–b* and sides 43*a–b*. The core bottom is formed with a longitudinally-extending fold 55 configured correspondingly with respect to fold 35 of outer seal 20 so that the core and outer seal nest. The tubular outer wall has lower corner regions 56*a–b* which engage portions of channel bottom 28 and upper corner regions formed with indentations 57*a–b* to accommodate core-retaining flanges 30*a–b*.

Figure 3A:
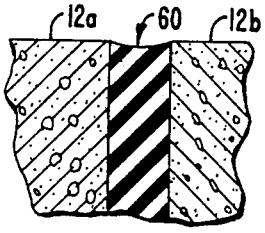
FIGS. 3A–E are cross-sectional views illustrating a procedure for installing the joint seal in existing concrete.
Figure 3B:
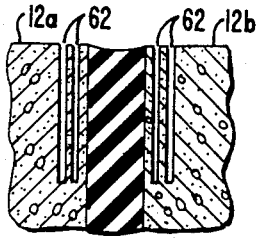
Figure 3C:
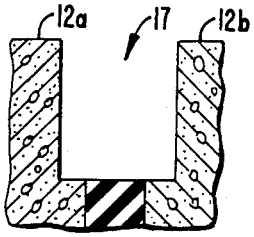
Figure 3D:
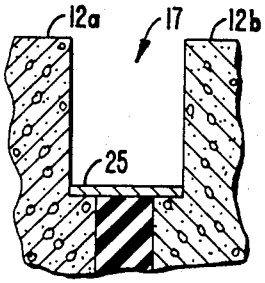

FIGS. 3A-E are cross-sectional views illustrating the sequence of steps for preparing the joint and installing seal 10. FIG. 3A shows the original joint, designated 60, between slabs 12*a* and 12*b*. As noted above, the joint has previously been filled with a compressible resilient material, such as polysulfide resin. The first step entails forming a number of parallel, vertical sawcuts with a diamond-tipped saw. This is preferably done in two passes. FIG. 3B shows the result of the first pass wherein four vertical sawcuts 62 have been made in the concrete slabs. The outermost extent of the sawcuts provides a dimension very slightly less than the ultimate width of seal-receiving recess 17, and the depth is very slightly less than the ultimate depth of the seal-receiving recess. In the present case, the ultimate width and depth are 1.875 inches (about 4.8 cm) and 2.5 inches (about 6.4 cm), respectively. The sawcuts, once made, leave relatively thin slices of concrete. FIG. 3C shows these strips having been broken away and the debris removed. A second pass with the saws set to establish the final dimensions provides the finished seal-receiving recess 17. FIG. 3D shows the finished seal-receiving recess with backing strip 25 in place.

Figure 3E:
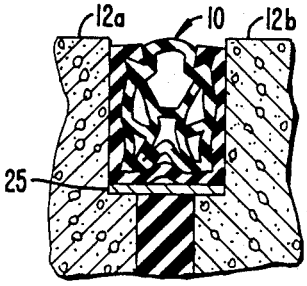

FIG. 3E shows the finished joint with seal 10 having been compressed and seated in recess 17. Once the seal is installed, it is flush with or slightly below the upper surface of the concrete slabs, and therefore is not subject to damage when vehicles drive over the joints, as for example when the bottom of the canal is cleaned.

Outer seal 20 is formed in sufficient lengths to extend the entire length of the joint without gaps. Core 22, on the other hand, is cut into sections of a few meters each. Prior to installation, the sections of core are placed into the outer seal, with adjacent core sections being separated by gaps of a few millimeters. Thus, once the canal is flooded, water occupies the core interior and any space between the core and the outer seal.

Seal 10 is installed under lateral compression, generally on the order of 15% compression. A lubricant is normally used to facilitate installation. The lubricant may be applied to the concrete or the rubber, or both. Application to the concrete is typically easier, and is therefore generally preferred. A polyurethane resin is preferred since it acts as an adhesive when it sets, thereby enhancing the engagement between fins 32 and slab edges 18*a–b*. Additionally, the resin tends to seal small fissures or voids in the concrete, further enhancing the integrity of the rubber-to-concrete contact.

The effectiveness of the seal derives jointly from the resilience of the compressed seal and the pressure of the water that fills the seal interior. As noted above, the core interior and the interstice between the core and outer seal are in fluid contact with the water above the slabs, so that the water pressure acts outwardly on the bottom and sides of the seal.

Performance and Testing of Preferred Embodiment

The purpose of the internal webs in core 20 is to control the transverse deformation in a manner that keeps the core sides as vertical as possible. With the core sides vertical, the reaction forces from the deformed core top and bottom and the deformed webs are transmitted to the channel sides to maintain an effective seal.

Figure 4A:
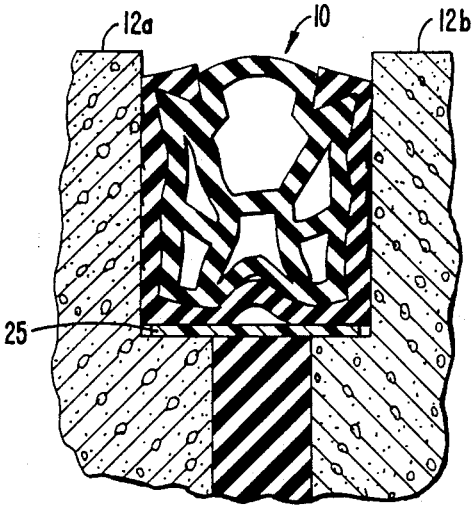
FIGS. 4A–B are cross-sectional views showing the deformation of the joint seal under design loads.
Figure 4B:
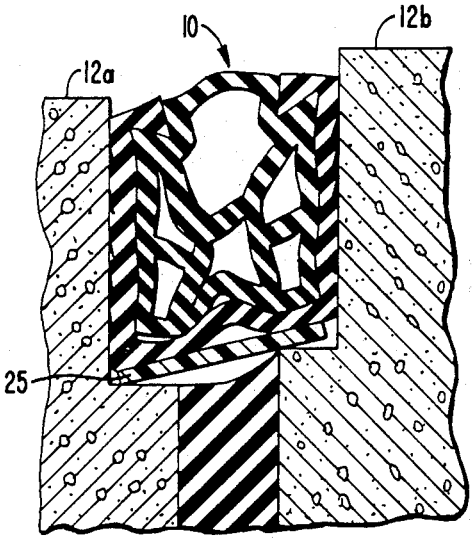

FIGS. 4A-B are cross-sectional views illustrating the deformation that the seal undergoes when subjected to the compressive and differential vertical loading. FIG. 4A shows the deformation resulting from the compressive loading at installation. It will be noted that the seal undergoes a symmetric deformation where channel sides 27*a–b*, and more particularly fins 32, maintain their frictional engagement with facing edges 15*a–b* of seal-receiving recess 17. Medial fold 35 in outer seal 20 and medial fold 55 in core 22 operate to control the deformation so that it occurs predictably.

FIG. 4B shows the deformation when one of the lower corners of the seal is displaced vertically relative to the other. In this case, it is noted that the internal web structure operates to maintain core sides 43*a–b* and channel sides 27*a–b* in substantial parallelism despite significant vertical displacement. The initial lateral compression provides reserve both for joint expansion and for such differential vertical displacement.

The preferred embodiment was subjected to bench testing wherein a structural steel test frame supported two parallel concrete sidewalls to simulate the cut joint. One sidewall was displaceable vertically and laterally relative to the other by means of turnscrews. The ends of the joint were sealed with a rubber cement (Isoflex 907 from H. S. Peterson Co.) and the region over the joint was sealed with a rubber cover plate in order to allow the seal to be subjected to a range of hydrostatic pressures. The seal used in initial testing was poorly fabricated, with jagged fins, and could not sustain 9 psi pressure (leaking occurred at pressures between 3.5 and 8 psi). A seal having thicker fins with smooth continuous edges was fabricated for the subsequent test. The sawcut concrete sidewalls had any pinholes and aggregate voids filled with epoxy.

Table 1 shows a summary of the test results. As can be seen, the seal was able to maintain 9 psi pressure at vertical displacements of up to ½ inch for gap widths of up to 2 inches. At the nominal gap width of 1.875 inches, and no vertical displacement, the seal was able to withstand up to 35 psi pressure before leaking.

Computer Modeling

Figure 5A:
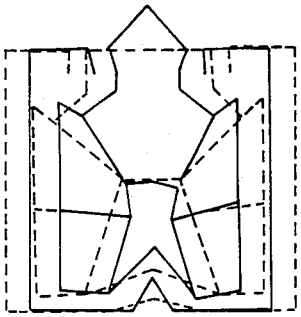
FIGS. 5A–B are computer-generated deformed geometry plots showing the deformation of the preferred embodiment under anticipated loadings.
Figure 5B:
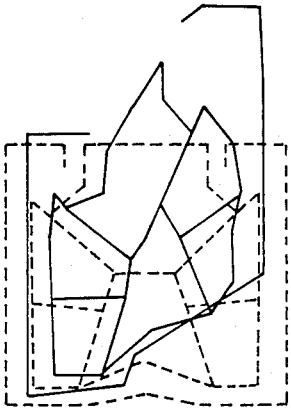

FIGS. 5A–B are deformed geometry plots, which were generated in connection with a beam model analysis of the preferred embodiment. Dashed lines denote the original (undeformed) configuration while solid lines show the deformed configuration.

The analysis utilized the computer program ANSYS, a general-purpose, finite element computer program for static or dynamic structural analysis, supplied by Swanson Analysis Systems, Inc., of Houston, Pa. The program is capable of including non-linear effects of material, geometry, and "gap elements." The assumptions regarding materials and loading were relatively conservative, as will now be described.

As noted above, the seal is made of neoprene rubber, which, depending on the exact composition, exhibits considerable variation in its properties. The modulus of elasticity is one property subject to a large degree of variation. Therefore, while a value of 3500 psi was initially used, a value of 1000 psi was also used to confirm the validity of the results. Conservative values were used for the coefficients of friction (0.8 for rubber-to-concrete and 0.6 for rubber-to-rubber). The actual value of the rubber-to-concrete coefficient is higher since the value used does not take into account the serrated edges provided by fins 32 or the lubricant-/adhesive applied to the seal prior to installation. A conservatively high value for the coefficient of thermal expansion was used to analyze the effect of temperature change on the seal performance, but temperature effects proved to be negligible.

The analysis recognized the four primary loadings to which the seal is subject, namely those resulting from installation (lateral compression), water pressure, temperature, and differential vertical displacement due to settlement of the concrete slabs. These four loadings occur in sequence in the field and were addressed in that manner in the analysis.

The installation load, in which the seal is compressed into place in the seal-receiving recess between the slabs, was represented as equal opposed displacements on both sides of the seal. The water pressure load is a uniform pressure load pushing out on the exterior surfaces of the seal. The temperature load, represented by a uniform cooling from 60° C. in direct sunlight during the warmest part of the year to 10° C. during the coolest part of the year, was found to have a negligible effect. The differential vertical load was represented by a 1-inch (2.5-cm) displacement of one side of the seal relative to the other. The analyses were static, non-linear structural analyses where the applied displacement, temperature, and pressure loadings were considered with no time-dependent effects. No unloading effects were considered, but rather all loadings that were applied remained in effect.

The material was modeled with a linear stress-strain curve, and so no plastic effects were considered. However, geometric non-linearities were considered due to the magnitudes of the applied vertical displacements. These displacements are large enough compared to the dimensions of the structure that the stiffness of the distorted structure is no longer described by its original geometry, and must be successively redefined based on the distorted geometry.

The contact between core 22 and outer seal 20 and between the outer seal and the concrete recess were modeled with gap elements, which are structural, compression-only axial elements. Gap elements provide resistance to compression, but no tensile stiffness, and have a sliding capability in that while in contact, they slide if the tangential force exceeds the product of the coefficient of friction and the normal force.

The consideration of large displacements and the inclusion of gap elements in the model make the analysis non-linear. The non-zero coefficients of friction make the analysis non-conservative (path-dependent); that is, the results make be affected by the sequence and incremental magnitudes of the loadings. The ANSYS program solves non-linear problems as a series of linear problems where the loads are applied in incremental load steps. Each load step is solved in a series of iterations until a convergent solution is obtained. Convergence is defined as occurring when the displacements and gap statuses (in contact, sliding contact, or open) change by less than specified amounts between successive iterations. The non-conservative nature of the process was handled by applying the load steps in the order they occur in the field.

FIG. 5A shows the deformed geometry plot of the preferred embodiment under the action of the installation and water pressure loads. FIG. 5B shows the deformed geometry plot of the preferred embodiment after the differential vertical displacement loading has been applied. Despite the large degree of deformation (the vertical displacement is 50% of the seal dimension), the vertical sides of the core and outer seal are deformed surprisingly little and remain vertical to maintain effective sealing. The maximum stress is about 900 psi, which is well within the elastic range and much less than the ultimate tensile strength of about 3500 psi. A comparison of the computer-generated plots of FIGS. 5A–B with the actual deformations shown in FIGS. 4A–B shows good correspondence, thereby justifying confidence in the computer model.

Alternative Embodiments

Figure 6:
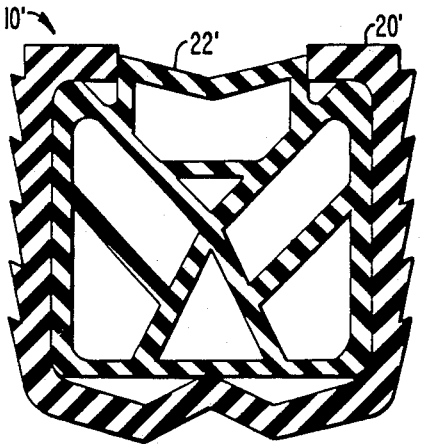
FIGS. 6 and 7 are cross-sectional views of alternative embodiments.
Figure 7:
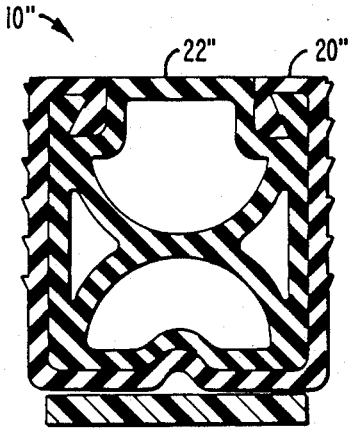
Figure 8A:
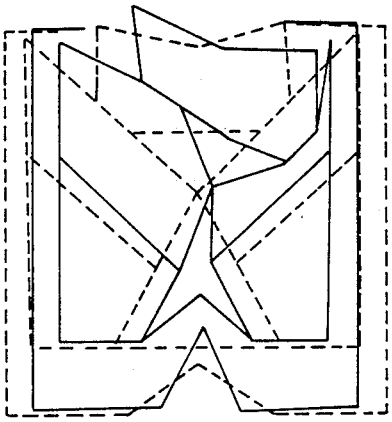
FIGS. 8A–B and 9A–B are deformed geometry plots for the alternative embodiments.
Figure 9A:
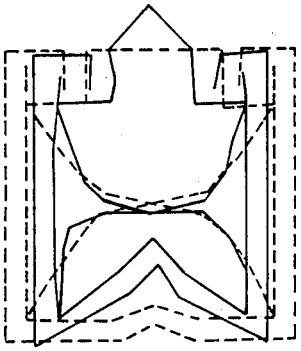
Figure 8B:
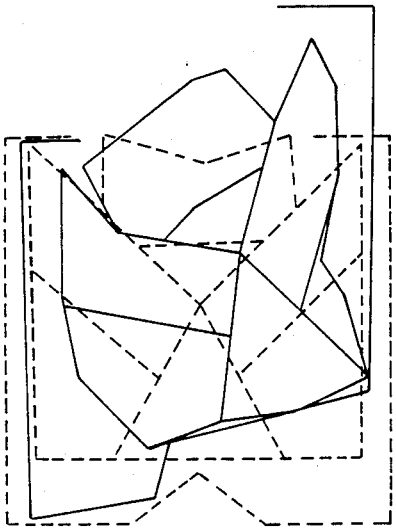
Figure 9B:
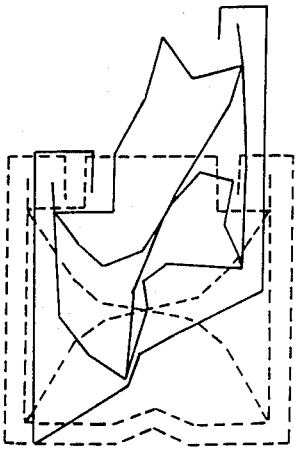

FIGS. 6 and 7 are cross-sectional views illustrating alternative embodiments. Primed and double-primed reference numerals denote elements corresponding to those in FIGS. 2A–B. The embodiment of FIG. 6 is somewhat larger, 2.5 inches (6.35 cm) on a side, and differs further from the preferred embodiment in that the core bottom is straight rather than formed with a medial fold and that the major webs in the core come together at a single point rather than at a pair of points spaced apart by a central web. The embodiment of FIG. 7 differs in that the internal webs within the core are curved rather than flat as in the other embodiments.

FIGS. 8A–B and 9A–B are the deformed geometry plots for the alternative embodiments. The fundamental difference in response between these embodiments and the preferred embodiment occurs in the differential displacement loading, where the alternative embodiments exhibit a greater degree of deformation. In particular, it is noted that the lower corner of the core pulls significantly away from the wall, thereby allowing the outer seal to pull away so that leakage could possibly occur.

Approximately 1200 meters of the seal embodiment shown in FIG. 6 was installed in a section of canal, and performed correctly. The smaller embodiment of FIGS. 2A–B was developed for areas of lesser slab thickness. Since the smaller seal appears superior on the basis of the computer modeling, and uses less material, it is considered the preferred embodiment regardless of slab thickness.

Conclusion

In conclusion, it can be seen that the present invention provides a concrete joint seal that is simple to install and maintain and highly effective in preventing leakage under a wide variety of conditions.

While the above is a complete description of the preferred embodiments of the invention, alternate constructions, modifications, and equivalents can be employed. For example, the core, rather than being installed as completely separate sections, could be formed in one section, but having a number of gaps in the top to allow water in. Additionally, while the core and outer seal are normally formed of the same material, thereby avoiding any possible incompatibility, there may be some benefits to having one of the elements harder than or otherwise different from the other. Therefore, the above description and illustrations should not be taken as limiting the scope of the invention which is defined by the appended claims.

TABLE 1

SUMMARY OF TEST RESULTS

| Horizontal Spacing of Concrete Joint, in. | Vertical Displacement of Side Concrete Wall, in. | Test Pressure, psi | Test Pressure, min. | Remarks |
|---|---|---|---|---|
| 1⅞ | 0 | 9 | 15 | No leaks |
| 1⅞ | ⅛ | 9 | 15 | No leaks |
| 1⅞ | ¼ | 9 | 15 | No leaks |
| 1⅞ | ⅜ | 9 | 15 | No leaks |
| 1⅞ | ½ | 9 | 15 | No leaks |
| 1¾ | 0 | 9 | 15 | No leaks |
| 1¾ | ⅛ | 9 | 15 | No leaks |
| 1¾ | ¼ | 9 | 15 | No leaks |
| 1¾ | ⅜ | 9 | 15 | No leaks |
| 1¾ | ½ | 9 | 15 | No leaks |
| 1⅝ | 0 | 9 | 15 | No leaks |
| 1⅝ | ⅛ | 9 | 15 | No leaks |
| 1⅝ | ¼ | 9 | 15 | No leaks |
| 1⅝ | ⅜ | 9 | 15 | No leaks |
| 1⅝ | ½ | 9 | 15 | No leaks |
| 1⅞ | 0 | 9 | 15 | After 3 mins. a single teardrop exuded past the rubber joint seal. There were no other leaks. |
| 2 | 0 | 9 | 15 | There was slight dripping/weeping at three locations along the rubber joint seal. |
| 2 | ⅛ | 9 | 15 | Dripping stopped at one location; continued at other two locations. |
| 2 | ⅜ | 9 | 15 | After 10 mins. the dripping stopped completely. |
| 2 | ½ | 9 | 15 | No leaks |
| 2⅛ | 0 | — | — | Water leaked past the rubber joint seal on the right sidewall. A constant test pressure could not be sustained. |
| 1⅞ | 0 | 35 | — | The rubber joint seal was loaded to failure. Water leaked past the seal at 35 psi. |

We claim:

1. A seal for insertion into a gap of rectangular cross-section between facing edges of adjacent concrete slabs comprising:

an elastomeric sealing element adapted to extend longitudinally within the gap, being in the form of a generally U-shaped channel with a pair of opposed channel sides, a channel bottom spanning respective lower ends of said channel sides and being formed with an upwardly extending, downwardly opening center fold, and a pair of inwardly extending flanges, each formed at an upper end of a respective one of said channel sides, said channel sides each having inner and outer surfaces, said outer surfaces being formed for frictional engagement with the slab edges when the seal is inserted into the gap; and an elastomeric core element having a tubular outer wall and an internal framework of interconnecting webs;

said tubular outer wall having a pair of core sides, a core top, and a core bottom, said tubular outer wall having lower corner regions and upper corner regions formed with recesses;

said tubular outer wall being configured so as to fit within said sealing element with said core sides contacting said inner surfaces of said channel sides, at least a portion of said core bottom contacting said center fold in said channel bottom, at least said lower corner regions of said tubular outer wall engaging said channel bottom, and said recesses engaging said flanges;

said interconnecting webs including major webs extending diagonally from regions near the corners of said tubular outer wall to a central region within said tubular outer wall, said interconnecting webs acting to resist horizontal compression while accommodating shear so as to maintain said channel sides in contact with said slabs under differential vertical movement of said slabs.

2. The seal of claim 1 wherein said sealing element is formed with longitudinally extending fins on said outer surfaces of said channel sides.

3. The seal of claim 1 wherein said core bottom is formed with an upwardly extending, downwardly opening center fold configured to nest with said center fold of said channel bottom.

4. The seal of claim 1 wherein said major webs are flat.

5. The seal of claim 1 wherein said major webs are curved.

6. The seal of claim 1 wherein said outer seal and said core element are formed of extruded neoprene.

7. The seal of claim 1 wherein said sealing element and said core element are formed to permit hydrostatic pressure above the seal to exert an outward force on said channel sides.

8. A seal for insertion into a gap of rectangular cross-section between facing edges of adjacent concrete slabs comprising:

an elastomeric sealing element adapted to extend longitudinally within the gap, being in the form of a generally U-shaped channel with a pair of opposed channel sides, a channel bottom spanning respective lower ends of said channel sides and being formed with an upwardly extending, downwardly opening center fold, and a pair of inwardly extending flanges, each formed at an upper end of a respective one of said channel sides, said channel sides each having inner and outer surfaces, said outer surfaces being formed with longitudinally extending fins for frictional engagement with the slab edges when the seal is inserted into the gap; and an elastomeric core element having a tubular outer wall of generally rectangular cross-section, and an internal framework of interconnecting webs.

said tubular outer wall having a pair of core sides, a core top, and a core bottom, said tubular outer wall having lower corner regions and upper corner regions formed with recesses;

said tubular outer wall being configured so as to fit within said sealing element with said core sides contacting said inner surfaces of said channel sides, at least a portion of said core bottom contacting said center fold in said channel bottom, at least said lower corner regions of said tubular outer wall engaging said channel bottom, and said recesses engaging said flanges;

said interconnecting webs including flat major webs extending diagonally from regions near the corners of said tubular outer wall to a pair of horizontally spaced convergence points, and a central horizontal web spanning said convergence points.

9. The seal of claim 8 wherein said core bottom is formed with an upwardly extending, downwardly opening center fold configured to nest with said center fold of said channel bottom.

10. The seal of claim 8 wherein said outer seal and said core element are formed of extruded neoprene.

11. A method of sealing the gap between adjacent slabs in a liquid-retaining structure, comprising the steps of:

providing an elastomeric seal that includes an outer sealing element in the form of a generally U-shaped channel having a pair of channel sides, a channel bottom spanning respective lower ends of the channel sides and having an upwardly extending, downwardly opening center fold, and a pair of inwardly extending flanges, each formed at an upper end of a respective one of the channel sides, and an inner core element in the form of a hollow open-ended rectangular tube with an internal reinforcing framework of interconnecting webs;

inserting the core element within the outer sealing element so that the core element contacts the channel sides, and the flanges positively retain the core element with at least lower corner portions of the core element engaging the channel bottom and bottom portions of the core element engaging the center fold;

forming a longitudinally extending seal-receiving recess of rectangular cross-section having a bottom seal-engaging portion and a width less than the width of the seal; and installing the seal under lateral compression with the seal-receiving recess with the outer sealing element in a continuous strip coextensive with the joint to be sealed and the inner core element in segments with gaps therebetween to allow water to infiltrate the seal interior.

12. The method of claim 11, and further comprising the step, carried out before said installing step, of placing a backing strip along the bottom of the seal-receiving recess.

13. The method of claim 11, and further comprising the step, carried out before said installing step, of applying a lubricant to the vertical concrete surfaces of the recess or the vertical surface of the seal.

* * * * *

UNITED STATES PATENT AND TRADEMARK OFFICE

CERTIFICATE OF CORRECTION

PATENT NO. : 4,861,043

DATED : August 29, 1989

INVENTOR(S) : Joseph Anderson, Barney T. Baldi, John M. Engstrom

It is certified that error appears in the above-identified patent and that said Letters Patent is hereby corrected as shown below:

Title page, item [73]:

change Assignee from "Bechtel International Corporation" to --Bechtel Investments, Inc.--

Signed and Sealed this

Second Day of October, 1990

*Attest:*

HARRY F. MANBECK, JR.

*Attesting Officer*

*Commissioner of Patents and Trademarks*